US009826879B2

(12) United States Patent
Rueckheim et al.

(10) Patent No.: US 9,826,879 B2
(45) Date of Patent: Nov. 28, 2017

(54) WIPING DEVICE

(71) Applicant: CARL FREUDENBERG KG, Weinheim (DE)

(72) Inventors: Markus Rueckheim, Griesheim (DE); Andreas Eisenhut, Pullach (DE); Jens Deerberg, Essen (DE); Torsten Gratzki, Essen (DE)

(73) Assignee: CARL FREUDENBERG KG, Weinheim (DE)

( * ) Notice: Subject to any disclaimer, the term of this patent is extended or adjusted under 35 U.S.C. 154(b) by 171 days.

(21) Appl. No.: 14/646,736

(22) PCT Filed: Aug. 8, 2013

(86) PCT No.: PCT/EP2013/002379
§ 371 (c)(1),
(2) Date: May 22, 2015

(87) PCT Pub. No.: WO2014/079518
PCT Pub. Date: May 30, 2014

(65) Prior Publication Data

US 2015/0313440 A1 Nov. 5, 2015

(30) Foreign Application Priority Data

Nov. 23, 2012 (EP) ..... 12007897

(51) Int. Cl.
*A47L 13/256* (2006.01)
*A47L 13/16* (2006.01)
*A47L 13/258* (2006.01)

(52) U.S. Cl.
CPC ..... *A47L 13/256* (2013.01); *A47L 13/16* (2013.01); *A47L 13/258* (2013.01)

(58) Field of Classification Search
CPC ..... A47L 13/256; A47L 13/258
USPC ..... 15/231
See application file for complete search history.

(56) References Cited

U.S. PATENT DOCUMENTS 5,218,734 A * 6/1993 Sacks ..... A47L 13/258 15/147.1
7,954,197 B2 * 6/2011 Lindner ..... A47L 13/20 15/228

FOREIGN PATENT DOCUMENTS

DE 8434817 U1 2/1985
DE 9402579 U1 3/1995
DE 19921661 A1 * 11/2000 ..... A47L 13/256

* cited by examiner

*Primary Examiner* — Laura C Guidotti
(74) *Attorney, Agent, or Firm* — Leydig, Voit & Mayer, Ltd.

(57) ABSTRACT

A wiping device, having a substantially rectangular support member having a longitudinal axis and two long sides, and a transverse axis and two transverse sides, on which a wiping cloth can be releasably fastened, wherein on the support member on at least one transverse side a pivotable fastening clamp is disposed so as to be pivotable about an articulation joint, for fastening of a fastening tab disposed correspondingly on at least one transverse side on the wiping cloth. The at least one fastening clamp is movable in a pivot plane which is disposed substantially perpendicular to the longitudinal axis of the support member.

19 Claims, 6 Drawing Sheets

View A

View B

Cross-section CC

View B

View A

WIPING DEVICE

CROSS-REFERENCE TO RELATED APPLICATIONS

This application is a U.S. national stage application under 35 U.S.C. §371 of International Application No. PCT/EP2013/002379, filed on Aug. 8, 2013, and claims benefit to European Patent Application No. 12007897.7, filed on Nov. 23, 2012. The International Application was published in German on May 30, 2014, as WO 2014/079518 A1 under PCT Article 21(2).

FIELD

The invention relates to a wiping device.

BACKGROUND

Such wiping devices are generally known. The main body here in the region of its two transverse sides displays in each case one pivotable fastening clamp, wherein the fastening clamps are in each case movable in one pivoting plane. The pivoting planes are in each case disposed so as to be perpendicular to the transverse axis of the main body.

In the case of an arrangement and pivotability of this type of the fastening clamps it is mainly disadvantageous that the width of the fastening clamps in relation to the width of the main body is only comparatively modest.

On account thereof, only fastening tabs of the wiping cloth which are likewise configured so as to be comparatively narrow can be accommodated, such that overall the previously known wiping device can only be operated using a number of wiping cloths which is limited to an undesirably great extent. Moreover, when the wiping device is used as intended, there is the risk of the wiping cloth, which is fastened to the main body, gradually detaching itself together with the fastening tabs thereof from the fastening clamps, in particular when the main body is configured as the main body of a wing-type squeeze mop and the wiping cloth, sagging in a U-shaped manner, is wringable in a wringing unit.

The weight force of the wiping cloth runs parallel in relation to the pivoting plane of the fastening clamps. This is particularly disadvantageous with respect to reliable fastening of the wiping cloth on the main body when the wiping cloth is wet.

SUMMARY

An aspect of the invention provides a wiping device, comprising: a substantially rectangular main body; a pivotable fastening clamp; and a fastening tab, wherein the main body has one longitudinal axis, two longitudinal sides, one transverse axis, and two transverse sides, wherein a wiping cloth is releasably fastenable on the main body, wherein at least one transverse side of the main body includes the pivotable fastening clamp configured to fasten the fastening tab, wherein the fastening tab is correspondingly disposed at least on one transverse side on the wiping cloth, wherein the main body is disposed so as to be pivotable about an articulation, wherein the fastening clamp is movable in a pivoting plane, and wherein the pivoting plane is disposed so as to be substantially perpendicular to the longitudinal axis of the main body.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
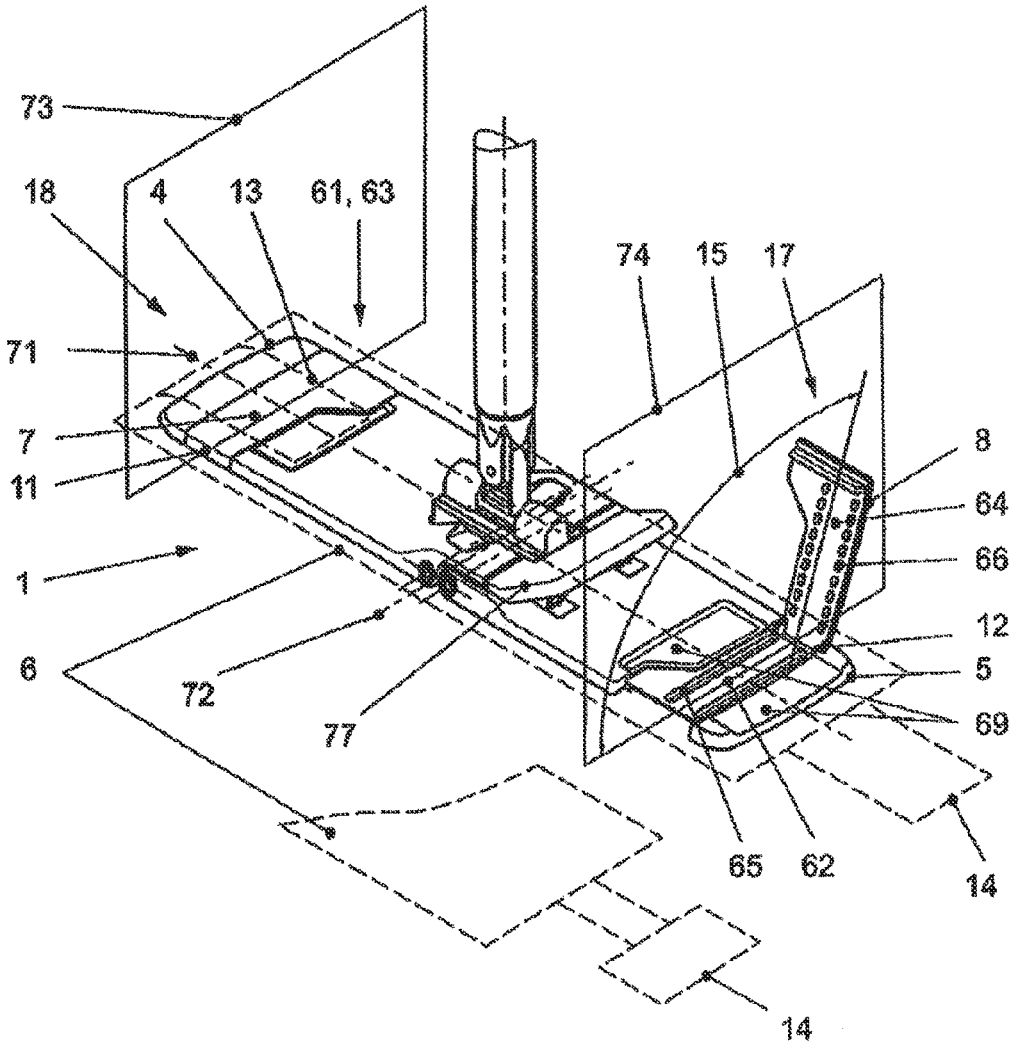
FIG. 1 shows a perspective view of the wiping device, seen from obliquely above.

An aspect of the invention provides a refined wiping device of the previously known type in such a manner that variably wide fastening tabs of the wiping cloth are fastenable on the main body in a particularly durable and reliable manner.

In an aspect of the invention, at least one fastening clamp is movable in a pivoting plane which is disposed so as to be substantially perpendicular to the longitudinal axis of the main body.

The term "substantially perpendicular to the longitudinal axis of the main body" preferably is meant to be understood as a region of ±45°, proceeding from the perpendicular of the pivoting plane.

On account of the pivotability of the fastening clamp in a pivoting plane which is disposed so as to be substantially perpendicular to the longitudinal axis of the main body, there exists the possibility for the fastening clamp in the pivoting plane to be configured in a very wide manner, such that fastening tabs of the wiping cloth are fastenable by means of the fastening clamp on the main body also when, for example, the fastening tab displays a width which corresponds to almost the width of the main body. On account thereof, the main body is suited to accommodating wiping cloths having fastening tabs of most variable widths and, on account thereof, may be employed in a very universal manner.

Moreover, it is advantageous that the fastening tab extends so as to be parallel with the longitudinal axis of the main body and perpendicular to the pivoting plane of the fastening clamp. Good durability is thus also ensured when the fastening tab is exposed to tensile stress on account of the intended use of the wiping device.

According to one advantageous design embodiment, it may be provided that on the main body, on both transverse sides, in each case one pivotable fastening clamp, for fastening fastening tabs which are correspondingly disposed on both transverse sides on the wiping cloth, is disposed so as to be pivotable in each case about one articulation, and in that the two fastening clamps are movable in each case in a pivoting plane which are disposed so as to be substantially perpendicular to the longitudinal axis of the main body.

Fastening of a wiping cloth by way of two fastening tabs on two fastening clamps of the main body is particularly simple. Moreover, a wiping cloth having two fastening tabs is manufacturable in a simple and cost-effective manner.

If the wiping cloth is configured so as to be symmetrical in relation to its transverse axis, the risk of assembly errors when fastening the former on the main body is minimized. The user is practically not required to pay attention to the direction in which the wiping cloth is fixed on the main body.

According to one advantageous design embodiment, it may be provided that the wiping cloth on at least one transverse side displays a fastening pocket which at least in part encloses one transverse side of the main body. The fastening tab may be disposed on this fastening pocket. On account thereof, the user of the wiping device has the choice of whether to fasten the wiping cloth on one transverse side on the main body by way of the fastening pocket and on the other transverse side by way of the fastening tab, or whether to perform fastening of the wiping cloth on both transverse sides by way of the fastening tabs, using the fastening clamps on the main body, as previously described.

The fastening clamps may be disposed so as to be pivotable about pivot axes of the articulations, wherein the pivot axes of the articulations are disposed so as to be substantially parallel with the longitudinal sides of the main body. On account thereof, the pivot axes extend so as to be perpendicular to the pivoting plane. The articulations may be configured so as to be different, as will yet be explained later.

The fastening clamps in their pivoting planes may be pivotable about a first opening angle between an open position and a closed position, wherein the first opening angle preferably is 45° to 135°. In the case of first opening angles which are smaller than 90°, handling for fastening the wiping cloth by way of its fastening tabs on the main body may be more laborious, the wider the configuration of the fastening tabs. Threading of the fastening tab in the region of the articulation of the fastening clamps is particularly arduous in the case of small first opening angles.

Opening angles which are larger than 135° are disadvantageous to the extent that large pivot angles have to be covered for fastening the fastening tabs, and the fastening tabs meanwhile may be displaced from their favorable position between the fastening clamps and the main body.

Preferably, the first opening angle is at least 90°. On account thereof, it is ensured that, by way of fastening clamps which project in a perpendicular manner from the main body, also wide fastening tabs are readily insertable and subsequently fastenable between the main body and the fastening clamp by the user.

Furthermore preferably, the first opening angle may be 110°. Such a large opening angle is outstandingly advantageous in particular for professional applications, particularly when the user is working while wearing gloves and changing of the wiping cloth has to be performed particularly often and/or swiftly.

The fastening clamps, for delimiting their first opening angle in the open position, may be placeable against in each case one stop. On account of the stop, the fastening clamp in its open position always occupies the same defined position in relation to the main body, such that handling of the wiping device is simplified, in particular when a wiping cloth as has been previously described is changed comparatively often.

Handling of the wiping device may be further simplified in that the articulations of the fastening clamps, for holding the fastening clamps in the open position, display in each case at least one latching position. In the respective latching position the fastening clamps assume a defined position in relation to the main body. In contrast to the previously described stops, the latching positions do not delimit the angle of the open position of the fastening clamps in relation to the main body in an absolute manner. For example, during movement in the open position, the fastening clamps may be moved beyond the latching position. It is advantageous here that, on account thereof, durability of the wiping device can be extended, even when the latter is to be applied in a rough, professional operation. Even when the fastening clamps are moved beyond their respective latching position into the open position, the fastening clamps do not break off.

Moreover, on account of their positioning in the latching position, the fastening clamps in the open position do not swing back and forth about the articulation in a hard-to-control manner—and thus in a manner which is difficult for the user to handle. In order to clamp the fastening tabs, the fastening clamps are then moved from the open position in the latching position back into their closed position.

Where, for example, only one latching position per fastening clamp is applied, the latter may delimit a second opening angle of 90°. A latching position having such an opening angle is well suited to many applications.

According to another design embodiment, there is the possibility for the fastening clamps to display in each case two latching positions which delimit a first second opening angle of 90° and a second second opening angle of 110°. Depending on the preferences of the respective user, the latter may lock in place the fastening clamps in one of the two latching positions when changing a wiping cloth.

The latching positions may be formed in each case by one ball which is impinged by a spring force and which is capable of being snap-locked in a first depression. Such latching positions display a simple construction, operate in a reliable and consistently good manner during a long service life, and are manufacturable in a cost-effective manner.

The fastening clamps may be disposed in the main body so as to be flush with the surface. It is advantageous here for the wiping device to have an overall smooth surface. On account thereof, the carrier plate having closed fastening tabs can be introduced without a problem into pockets on the upper side of a wiping cloth, as has already been described earlier. Moreover, flushness with the surface has the effect of no major contaminants settling on the surface of the carrier plate and of the fastening tabs. Minor contaminants may be wiped off without a problem. On account thereof, use of the wiping device is particularly hygienic also during a long service life.

The fastening clamps, on their sides which face away from the respective articulation, may display in each case one grip. On account of the grip, handling when fastening the wiping cloth to the main body, or when removing the wiping cloth from the main body, is simplified. On account of the grip it is clear to the user which point of the fastening clamp he has to grasp in order to be able to close or open the fastening clamp as easily as possible.

The width of the fastening clamps preferably substantially corresponds to the width of the main body. As long as the width of the fastening tabs of the wiping cloth is somewhat smaller than the width of the main body, on account of the wide fastening clamps the fastening tabs can be securely fastened on the main body. On account of the possibility for particularly wide fastening tabs to be able to be fastened on the main body by way of the fastening clamps, the wiping device can be operated using a large number of various wiping cloths. Variable widths of fastening tabs of different wiping cloths do not limit the versatility of the wiping device, the width of the fastening tabs of the wiping cloth to be clamped being delimited only by the width of the spacing between the articulation and the grip of the fastening clamps.

The articulations may be disposed in each case in the region of a longitudinal side of the main body, and the grips may be disposed in the region of that other longitudinal side of the main body that lies opposite in the transverse direction. On account of such a design embodiment, the leverage for opening and closing the fastening clamps is the highest possible. On account thereof, handling of the wiping device is also simplified when comparatively large forces have to be deployed for latching the fastening clamps in the closed position or for opening the fastening clamps.

The fastening clamps, in their closed position, may be connected to the main body in a form-fitting manner. Form-fitting connections, for example latching connections, are manufacturable in a simple and cost-effective manner. In contrast to releasable force-fitting connections, releasable form-fitting connections display better usage properties during a comparatively long service life. In particular, releasable form-fitting connections are less sensitive to contaminants Therefore, a form-fitting connection between the fastening clamps and the main body is particularly advantageous in the case of wiping devices.

According to one advantageous design embodiment, it may be provided that the grips of the fastening clamps display in each case one latching cam which are in each case engageable in a latching manner behind a latching protrusion in the respective longitudinal side of the main body. In the case of such a design embodiment the latching cam is at a maximum spacing from the articulation of the fastening clamps. The leverage for both opening and closing the latching connection is thus at maximum.

Furthermore, it may be provided that the latching cams are disposed so as to be flush with the surface in the lower side of the main body which faces the area to be cleaned. On account of the integration of the latching cams so as to be flush in the lower side of the main body, undesirable protrusions between the lower side of the main body and the upper side of the wiping cloth are avoided. The smooth lower side of the main body thus transmits the contact pressure of the user onto the wiping cloth in a uniform manner and, on account thereof, onto the area to be cleaned.

According to another design embodiment, it may be provided that the grips of the fastening clamps in the longitudinal direction of the main body in each case on both sides display one latching cam which are engageable in a latching manner behind in each case one latching protrusion of the main body. The respective longitudinal side of the main body in the case of such a design embodiment does not have to be encompassed by the latching cams. Such latching cams have no influence on the lower side of the main body.

For locking in place the fastening clamps, the main body in the region of its longitudinal edges may display in each case one clearance which extend parallel with the respective longitudinal edge, wherein latching cams of the fastening clamps are engageable in a latching manner in the clearance. The longitudinal edges of the main body extend so as to be continuous. Therefore, also the clearances are delimited by the longitudinal edges, likewise the latching cams which are disposed in the clearances. Even when the wiping device is moved directly along skirting boards, for example, the skirting boards do not touch the latching cams but only the longitudinal edges which in this case protect the latching cams from mechanical influences. The risk of the latching cams being released in an undesirable manner and of the fastening clamps, on account thereof, inadvertently freeing the fastening tabs is delimited to a minimum by such a design embodiment.

The fastening clamps may be fixable on the main body by in each case one press-stud connection. Press-stud connections are simple and durable, and during the intended use of the wiping device the user may immediately identify at a glance whether the press-stud connection is correctly locked.

According to one advantageous design embodiment, it may be provided that the grips of the fastening clamps in the direction of the longitudinal sides of the main body have a length of 2 cm to 4 cm. The mentioned length corresponds to the width of two or three fingers of the user which are placed side-by-side. On account of actuating the fastening clamps by way of two or three fingers, the stress per finger is reduced. If only one finger were used for actuating the fastening clamps, and the grip were to have a correspondingly modest length, handling of the wiping device would be significantly more difficult, in particular in the event of the wiping cloth being used having to be changed often.

The fastening clamps may be disposed so as to be laterally opposed to one another, wherein one of the fastening clamps is disposed so as to be pivotable about the pivot axis of the articulation thereof on the one longitudinal side of the main body, and the other fastening clamp is disposed so as to be pivotable about the pivot axis of the articulation thereof on the other longitudinal side of the main body. Such an arrangement of the fastening clamps is referred to as "laterally opposed". It is advantageous here that both fastening clamps are pivotable by the user from right to left, for example, about their respective articulation, so as to be brought into the open position. To this end, the user holds the carrier plate perpendicularly in front of him and initially releases/fastens the upper fastening clamp. Once accomplished, the user rotates the carrier body by 180° about the axis of the shaft of the wiping device, such that the holding-down device which is now at the top is likewise pivotable from right to left about the articulation so as to be brought into the open position. The fastening clamps which are arranged so as to be laterally opposed in relation to one another simplify handling of the wiping device.

According to one advantageous design embodiment, it may be provided that at least one articulation is formed by a film hinge which is configured so as to be transitionally integral and materially integral with the fastening clamp and/or the main body. A film hinge is particularly simple in constructive terms, and the wiping device overall has a construction with few parts. The film hinge may be composed for example of an elastically yielding polymer material and be configured so as to be thin in film-like manner.

According to another design embodiment, at least one articulation may be formed by axle stubs of the respective fastening clamp, wherein in each case one axle stub is disposed on one side in the longitudinal direction of the main body, and one axle stub is disposed on the other side in the longitudinal direction of the main body, and that the axle stubs are rotatably mounted in clearances of the main body which are designed in a congruent manner. Such a wiping device also has a construction with few parts. No additional components are required for the articulation.

The axle stubs form component parts of the fastening clamp, and the clearances are disposed in the main body. On account of the construction with few parts the wiping device, like the previously described wiping device in which the articulation is formed by a film hinge, displays only a modest weight.

The axle stubs and/or the clearances in which they are disposed, may display a first profiled surface pattern having an increased coefficient of friction. The increased coefficient of friction here is dimensioned such that the fastening clamps are held in their respective position by way of a self-locking effect in intermediate positions between the open position and the closed position, independently of how the carrier plate is held by the user. The fastening clamps do not move by their dead weight alone. Preferably, the axle stubs are provided with the first profiled surface pattern, since axles can be more easily provided with a profiled surface pattern than bores.

According to another design embodiment, it may be provided that at least one articulation is formed by a separately manufactured axle which is pivotably encompassed by the fastening clamp and is mounted in the main body. The axle here may be composed of a rustproof metallic material, for example. On account thereof, the axle is resistant to moisture and causes faultless pivotability of the fastening clamps about the respective axes even after a long service life of the wiping device.

The fastening clamp which encompasses the axle and/or the axles may have a second profiled surface pattern having an increased coefficient of friction. As described above, on account thereof, movement of the open fastening clamp which is controllable only with difficulty is avoided. On account thereof, the fastening clamps can be held in their respective position by way of a self-locking effect in intermediate positions between the open position and the closed position. On account thereof, the fastening tabs of the wiping cloth may be comfortably positioned and subsequently fastened between the fastening clamps and the main body.

For this reason it is advantageous for at least one articulation and the fastening clamp connected thereto to be configured in a self-locking manner.

The main body displays first clamping faces which face the fastening clamps, wherein the fastening clamps display second clamping faces which face the main body. The design embodiment of the clamping faces influences the durability of the fastening of the fastening tabs between the main body and the fastening clamps.

The first clamping faces and/or the second clamping faces may display elements for increasing the clamping force. In particular when the main body is foldable about a transverse axis which is disposed so as to be centric in the longitudinal direction, whereby a wet and thus heavy wiping cloth then hangs in a substantially perpendicular downward direction, elements for increasing the clamping force are of a distinct advantage.

The elements of the first and/or the second clamping faces may be formed by a profiled pattern. On account of such a profiled pattern, a form-fitting connection of the fastening tabs to the main body and/or to the fastening clamps may result.

The profiled patterns may be formed by elevations or depressions in the first clamping faces, which are disposed in depressions or elevations of the second clamping faces, with the fastening tabs of the wiping cloth being inserted therebetween. On account of these profiled patterns, a particularly durable meshing of the fastening tabs between the main body and the fastening clamps results.

Additionally or alternatively, the profiled patterns may be configured so as to be knurled.

The profiled patterns may be formed by pins which, proceeding from the fastening clamps or the main body, engage in a pin cushion of the main body or of the fastening clamps, while penetrating the fastening tabs of the wiping covering. On account of the pins penetrating the fastening tabs and being accommodated in the pin cushion, fastening of the fastening tabs between the main body and the fastening clamps is form-fitting and particularly durable. This results in a secure fixation of the wiping cloth by means of the fastening tabs, even if the tensile stresses of the fastening tabs are somewhat greater.

In addition to the embodiments previously described, or alternatively thereto, there is the possibility that the first and/or the second clamping faces are rubberized. On account of the rubberized clamping faces, friction is likewise increased and the durability of the fastening of the fastening tabs between the main body and the fastening clamps is maximized.

The fastening clamps may be configured so as to be pre-cambered in the direction of the respective transverse side of the main body. Pre-cambering is arcuate, for example. On account thereof, it is achieved that the articulation and the grip are disposed so as to be somewhat recessed from the transverse side of the main body. The articulation and the grip, therefore, are also protected from undesirable external influences when, for example, the transverse side are directly guided up to the walls or skirting boards during cleaning, that is to say during the intended use of the wiping device. Nevertheless, on account of the pre-cambered shape of the fastening clamps, even particularly short fastening tabs of the wiping cloth can be reliably connected to the main body.

According to one advantageous design embodiment, it may be provided that the main body, for receiving in a manner flush with the surface the fastening tabs of the wiping cloth, on both sides of the fastening clamps displays synclinal second depressions which are substantially parallel with the longitudinal axis of the main body, wherein the second depressions display in each case a depth which substantially corresponds to the thickness of the fastening tabs. During the intended use of the wiping device the clamped fastening tabs lie in the depressions so as to be flush with the surface. On account thereof, the fastening tabs do not protrude beyond the surface of the main body and contaminants can settle in this region only with difficulty. On account thereof, hygiene is improved, and the risk of fastening tabs projecting from the surface catching is reduced to a minimum.

Moreover, the invention relates to a main body for a wiping device as described hereinabove, wherein the at least one fastening clamp is movable in a pivoting plane which is disposed so as to be substantially perpendicular to the longitudinal axis of the main body. Such a main body may accommodate the widest variety of wiping cloths having fastening tabs of different lengths and/or widths in a particularly durable manner.

In each of the exemplary embodiments a wiping device which comprises a main body 1 and a wiping cloth 6, which are releasably connected to one another, is shown. The main body 1 is configured so as to be rectangular and has one longitudinal axis 71 and two longitudinal sides 2, 3. The transverse axis 72 is shown so as to be centric in the longitudinal direction. The wiping cloth 6 is releasably fastened in the region of the two transverse sides 4, 5.

On both transverse sides, the wiping device has pivotable fastening clamps 7, 8, which are disposed so as to be pivotable about articulations 11, 12. The two fastening clamps 7, 8, which display pivoting planes 73, 74 which are disposed so as to be substantially perpendicular to the longitudinal axis 71 of the main body 1, are provided for fastening fastening tabs 13, 14, which are correspondingly disposed on both transverse sides on the wiping cloth 6.

On one side of the main body 1 the fastening clamp 7 is shown with its pivoting plane 73, the fastening clamp 7 being in a closed position 18. In contrast, the other fastening clamp 8 is shown in the open position 17, the fastening clamp 8 being pivotable about its pivoting plane 74.

The first opening angle 15, 16, in the exemplary embodiments shown here, is in each case about 110°. On account thereof, the fastening tabs 13, 14 can be fastened between the main body 1 and the fastening clamps 7, 8, in a particularly simple manner.

A distinctive advantage is the arrangement of the fastening clamps 7, 8, in the main body 1, so as to be flush with the surface when the fastening clamps 7, 8, are located in the closed position. On account of this arrangement in the main body 1 so as to be flush with the surface, the transverse sides 4, 5, of the main body 1, if and when required, can be pushed without a problem into pockets which are disposed on both transverse sides on the wiping cloth 6. Moreover, such a wiping device is particularly easy to clean. There are no dirt traps, which is advantageous from the point of view of hygiene.

The width 33 of the fastening clamps 7, 8, in the exemplary embodiments shown here substantially corresponds to the width 34 of the main body 1, wherein each fastening clamp 7, 8, on its sides which faces away from the respective articulation 11, 12, displays in each case one grip 31, 32. The fastening clamps 7, 8 are disposed so as to be laterally opposed to one another. The grips 31, 32, form an integral part of the fastening clamps 7, 8, and have a width 47 in the direction of the longitudinal sides 2, 3, of the main body 1, which is 2 cm to 4 cm. On account thereof, actuating the fastening clamps 7, 8 is easily possible for the user in that he uses three fingers for actuating the fastening clamps 7, 8, for example.

The articulations 11, 12, and the fastening clamps 7, 8, which are connected thereto, in the exemplary embodiments shown here are configured so as to be self-locking, so as to prevent movement which is difficult to control of the fastening clamps 7, 8, back and forth about the articulations 11, 12, in the open position 17.

In order to increase the clamping force between the first clamping faces 61, 62, and the second clamping faces 63, 64, elements which is formed by the profiled patterns 65, 66 are provided. The profiled patterns 65, 66, may be formed by elevations or depressions in the first clamping faces 61, 62, which are disposed in depressions or elevations of the second clamping faces 63, 64, while the fastening tabs 13, 14 of the wiping cloth 6 is inserted therebetween. Additionally or alternatively, the clamping faces 61, 62, 63, 64, may be rubberized, for example.

In addition to the arrangement of the fastening clamps 7, 8, in the main body 1 so as to be flush with the surface, it is advantageous for the fastening tabs 13, 14 of the wiping cloth 6, to be also accommodated in the main body 1 so as to be flush with the surface. To this end, synclinal second depressions 69, 70, which are substantially parallel with the longitudinal axis 71 of the main body 1, are provided on both sides of the fastening clamps 7, 8, wherein the second depressions 69, 70, in each case display a depth which corresponds to the thickness of the fastening tabs 13, 14.

In FIG. 1 a perspective view of the wiping device, seen from obliquely above, is shown. The main body 1 comprises two wings 75, 76, which are lockable in relation to one another by way of the pedal 77, as illustrated here, or are foldable in relation to one another.

The wiping cloth 6 and its fastening tabs 13, 14, are illustrated using dashed lines.

Figure 2:
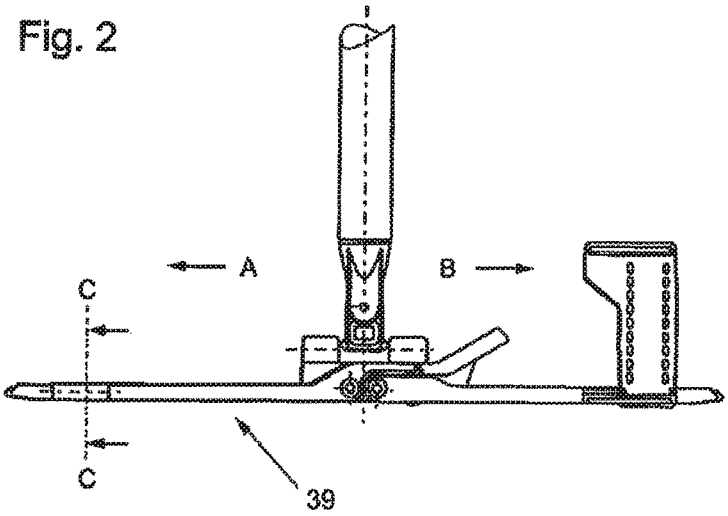
FIG. 2 shows a view of the wiping device from FIG. 1, from the front.

In FIG. 2 a view of the wiping device from FIG. 1 is shown from the front. The wings 75, 76, are locked in relation to one another in the position illustrated here by way of the pedal 77, the fastening clamp 7 being illustrated in its closed position, and the fastening clamp 8 being shown in its open position.

Figure 3:
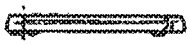
FIG. 3 shows the view A from FIG. 2.

In FIG. 3 the view A from FIG. 2 is shown. It can be seen that the fastening clamp 7 is disposed in the main body 1 so as to be flush with the surface.

Figure 4:
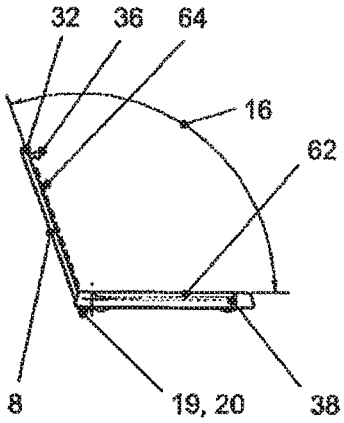
FIG. 4 shows the view B from FIG. 2.

In FIG. 4 the view B from FIG. 2 is shown. The first opening angle 16 of the fastening clamp 8, between the open position 17 and the closed position 18, in the exemplary embodiment shown here is 105°.

Figure 5:
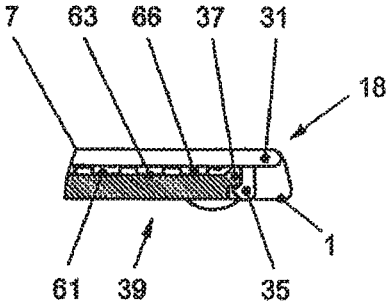
FIG. 5 shows the section C-C from FIG. 2.

In FIG. 5 the section C-C from FIG. 2 is shown. The first clamping faces 61, 62, and the second clamping faces 63, 64, display elements for increasing the clamping force, wherein said elements are configured as profiled patterns 65, 66. Each of the fastening clamps 7, 8, on its side which faces away from the respective articulation 11, 12, displays in each case one grip 31, 32. The grips 31, 32, display in each case one latching cam 35, 36, which is in each case engageable in a latching manner behind a latching protrusion 37, 38, of the respective longitudinal side 2, 3, of the main body 1.

Figure 6:
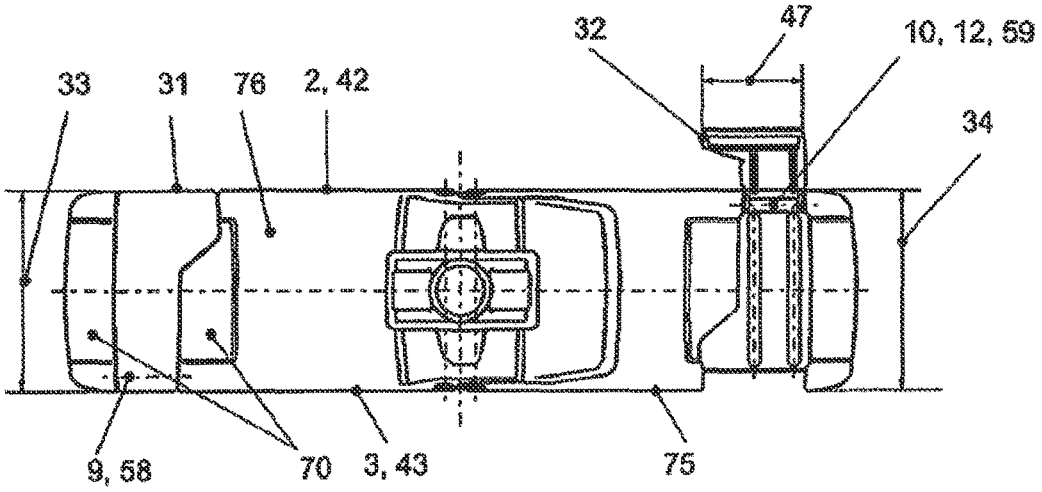
FIG. 6 shows a plan view onto the wiping device from FIG. 1.

In FIG. 6 a plan view onto the wiping device from FIG. 1 is shown.

Figure 7:
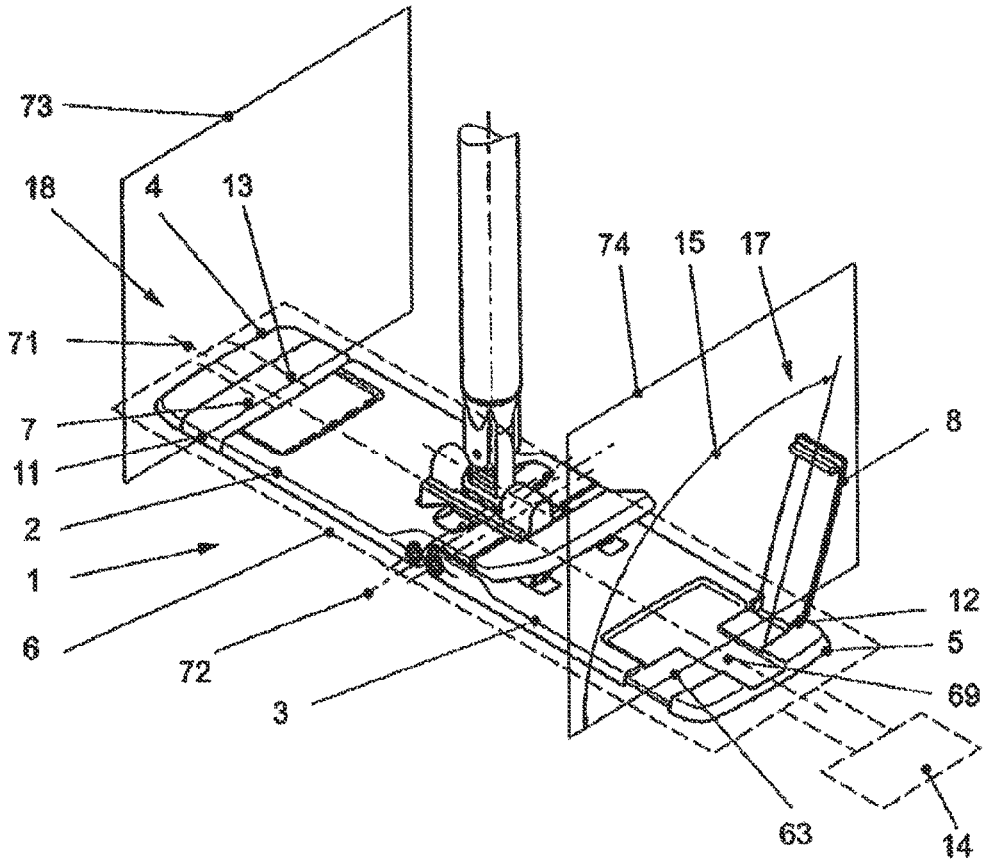
FIG. 7 shows a perspective view of the wiping device, seen from obliquely above.

In FIG. 7 a perspective view of the wiping device, seen from obliquely above, is shown. The substantial differences to the first exemplary embodiment according to FIGS. 1 to 6 are the fastening clamps 7, 8, and the type of the latching connection by way of which the former are fixed on the main body 1. For locking in place the fastening clamps 7, 8, the main body 1, in the region of its longitudinal edges 42, 43, displays in each case one clearance 44, 45, which extends parallel with the respective longitudinal edges 42, 43, wherein latching cams 35, 36, of the fastening clamps 7, 8, are engageable in a latching manner in the clearances 44, 45.

Figure 8:
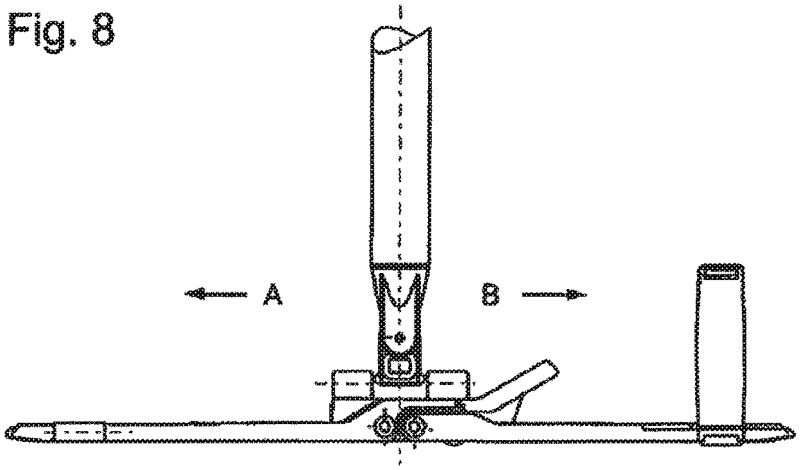
FIG. 8 shows a view of the wiping device from FIG. 7, from the front.
Figure 10:
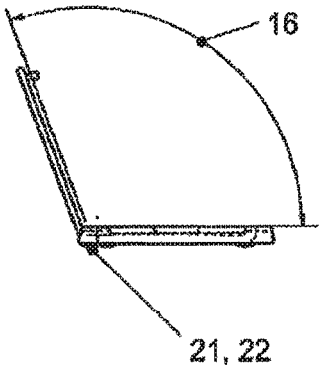
FIG. 10 shows the view B from FIG. 8.
Figure 9:
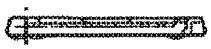
FIG. 9 shows the view A from FIG. 8.
Figure 11:
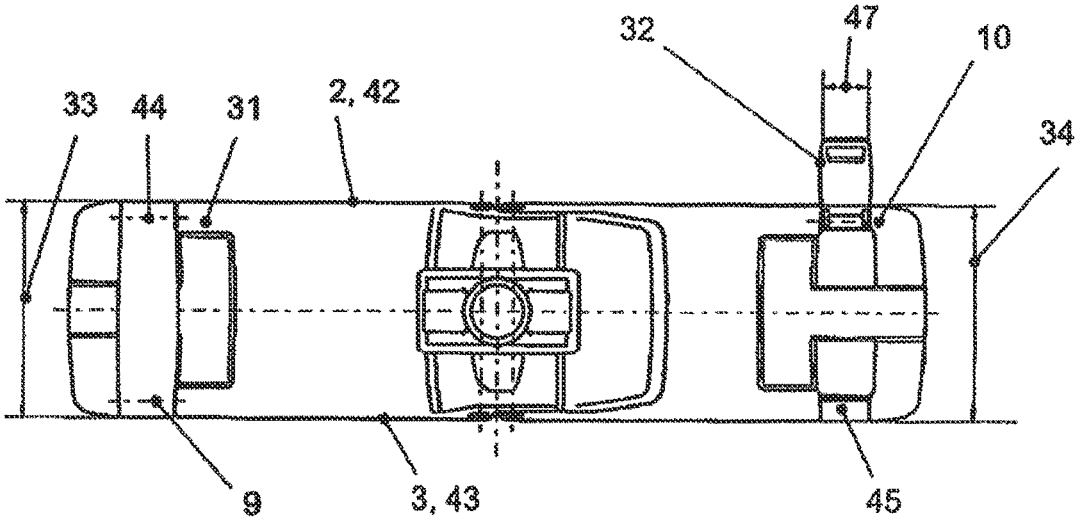
FIG. 11 is a plan view onto the wiping device from FIG. 7.

In FIG. 8 a view of the wiping device from FIG. 7, from the front, is shown. In FIG. 9 the view A from FIG. 8 is shown, in FIG. 10 the view B from FIG. 8 is shown, and in FIG. 11 a plan view onto the wiping device from FIG. 7 is shown.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A wiping device, comprising:

a substantially rectangular main body, the main body having one longitudinal axis, two longitudinal sides, one transverse axis, and two transverse sides, the main body comprising a pivotable fastening clamp disposed on one transverse side; and a wiping cloth releasably fastenable on the main body, the wiping cloth including a fastening tab disposed on one transverse side thereof corresponding to the one transverse side of the main body, wherein the fastening clamp is configured to fasten the fastening tab to the main body in a form-fitting manner on a longitudinal edge of the fastening clamp, wherein the fastening clamp is pivotable about an articulation, wherein the fastening clamp is movable in a pivoting plane, wherein the pivoting plane is disposed so as to be substantially perpendicular to the longitudinal axis of the main body, and wherein the fastening clamp is disposed in the main body so as to be flush with an upper surface of the main body when the fastening clamp is in a closed position, an upper surface of the fastening clamp being coplanar with the upper surface of the main body.

2. The device of claim 1, wherein the main body includes another pivotable fastening clamp on an other transverse side, for fastening fastening tabs, wherein the wiping cloth includes another fastening tab disposed on an other transverse side thereof corresponding to the other transverse side of the main body, wherein each fastening clamp is disposed so as to be pivotable in each case about one articulation, and wherein the fastening clamps are movable in each case in a pivoting plane, and wherein the pivoting planes are disposed so as to be substantially perpendicular to the longitudinal axis of the main body.

3. The device of claim 2, the fastening clamps are disposed so as to be pivotable about pivot axes of the articulations, and wherein the pivot axes are disposed so as to be substantially parallel with the longitudinal sides of the main body.

4. The device of claim 3, wherein the fastening clamps are disposed so as to be laterally opposed to one another, wherein one of the fastening clamps is disposed so as to be pivotable about the pivot axes of the articulation on one longitudinal side of the main body, and wherein the other fastening clamp is disposed so as to be pivotable about the pivot axes of the articulation on the other longitudinal side of the main body.

5. The device of claim 2, wherein the fastening clamps in their pivoting planes are pivotable about a first opening angle between an open position and a closed position, and wherein the first opening angle is in each case 45° to 135°.

6. The device of claim 2, wherein the fastening clamps, for delimiting their first opening angle in an open position, are placeable against in each case one stop.

7. The device of claim 2, wherein the articulations of the fastening clamps, for holding the fastening clamps in an open position, include a latching position.

8. The device of claim 2, wherein the articulations are disposed in each case in a region of a longitudinal side of the main body, wherein the fastening clamps include a grip on a side facing away from the articulations, and wherein the grips are disposed in a region of a longitudinal side of the main body that lies opposite in the transverse direction.

9. The device of claim 2, wherein the main body includes first clamping faces which face the fastening tabs, and wherein the fastening clamps include second clamping faces which face the main body.

10. The device of claim 9, wherein the first clamping faces, the second clamping faces, or both, include an element configured to increase the clamping force.

11. The device of claim 2, wherein the fastening clamps are configured so as to be pre-cambered in a direction of the respective transverse side of the main body.

12. The device of claim 2, wherein the main body, for receiving in a manner flush with the surface the fastening tabs of the wiping cloth, on both sides of the fastening clamps further includes synclinal second depressions which are substantially parallel with the longitudinal axis of the main body, wherein the second depressions include in each case a depth which substantially corresponds to a thickness of the fastening tabs.

13. The device of claim 1, wherein, on a side facing away from the articulation, the fastening clamp includes a grip.

14. The device of claim 1, wherein a width of the fastening clamp substantially corresponds to a width of the main body.

15. The device of claim 1, wherein the fastening clamp, in a closed position, is connected to the main body in a form-fitting manner.

16. The device of claim 1, wherein the main body, on both sides of the fastening clamp, includes synclinal second depressions that are substantially parallel with the longitudinal axis of the main body, the synclinal second depressions being configured to receive the fastening tab of the wiping cloth in a manner flush with the surface of the main body.

17. The device of claim 16, wherein the synclinal second depressions have, in each case, a depth that substantially corresponds to a thickness of the fastening tab.

18. A wiping device, comprising:

a substantially rectangular main body, the main body having one longitudinal axis, two longitudinal sides, one transverse axis, and two transverse sides, the main body comprising a pivotable fastening clamp disposed on one transverse side; and a wiping cloth releasably fastenable on the main body, the wiping cloth including a fastening tab disposed on one transverse side thereof corresponding to the one transverse side of the main body, wherein the fastening clamp is configured to fasten the fastening tab to the main body, wherein the fastening clamp is pivotable about an articulation, wherein the fastening clamp is movable in a pivoting plane, wherein the pivoting plane is disposed so as to be substantially perpendicular to the longitudinal axis of the main body, and wherein the fastening clamp is disposed in the main body so as to be flush with a surface of the main body when the fastening clamp is in a closed position, wherein the main body, on both sides of the fastening clamp, includes synclinal second depressions that are substantially parallel with the longitudinal axis of the main body, the synclinal second depressions being configured to receive the fastening tab of the wiping cloth in a manner flush with the surface of the main body.

19. A wiping device, comprising:

a substantially rectangular main body, the main body having one longitudinal axis, two longitudinal sides, one transverse axis, and two transverse sides, the main body comprising a pivotable fastening clamp disposed on one transverse side; and a wiping cloth releasably fastenable on the main body, the wiping cloth including a fastening tab disposed on one transverse side thereof corresponding to the one transverse side of the main body, wherein the fastening clamp is configured to fasten the fastening tab to the main body, wherein the fastening clamp is pivotable about an articulation, and movable in a pivoting plane, wherein the pivoting plane is disposed so as to be substantially perpendicular to the longitudinal axis of the main body, and wherein the fastening clamp is disposed in the main body so as to be flush with a surface of the main body when the fastening clamp is in a closed position, wherein the main body, on both sides of the fastening clamp, includes synclinal second depressions that are substantially parallel with the longitudinal axis of the main body, the synclinal second depressions being configured to receive the fastening tab of the wiping cloth in a manner flush with the surface of the main body, wherein the synclinal second depressions have, in each case, a depth that substantially corresponds to a thickness of the fastening tab.

* * * * *